US008221054B2

(12) United States Patent
Rao et al.

(10) Patent No.: US 8,221,054 B2
(45) Date of Patent: Jul. 17, 2012

(54) CORRUGATED HOOD FOR LOW PRESSURE STEAM TURBINE

(75) Inventors: Hayagreeva K V Rao, Andhra Pradesh (IN); Kumar Navjot, Jharkhand (IN)

(73) Assignee: General Electric Company, Schenectady, NY (US)

( * ) Notice: Subject to any disclaimer, the term of this patent is extended or adjusted under 35 U.S.C. 154(b) by 696 days.

(21) Appl. No.: 12/473,798

(22) Filed: May 28, 2009

(65) Prior Publication Data

US 2010/0303620 A1 Dec. 2, 2010

(51) Int. Cl.
*F01D 25/26* (2006.01)

(52) U.S. Cl. ..... 415/108; 415/214.1; 415/220

(58) Field of Classification Search ..... 415/108, 415/213.1, 214.1, 220
See application file for complete search history.

(56) References Cited

U.S. PATENT DOCUMENTS

| | | | | |
|---|---|---|---|---|
| 3,630,635 | A * | 12/1971 | Fatum | 415/214.1 |
| 4,013,378 | A | 3/1977 | Herzog | |
| 4,326,832 | A * | 4/1982 | Ikeda et al. | 415/213.1 |
| 5,167,123 | A | 12/1992 | Brandon | |
| 5,375,547 | A | 12/1994 | Abe et al. | |
| 5,495,714 | A * | 3/1996 | Gros et al. | 60/687 |
| 6,419,448 | B1 * | 7/2002 | Owczarek | 415/207 |
| 6,484,503 | B1 | 11/2002 | Raz | |
| 6,971,842 | B2 | 12/2005 | Luniewski et al. | |
| 2007/0081892 | A1 | 4/2007 | Sharrow | |

* cited by examiner

*Primary Examiner* — Ninh H Nguyen
(74) *Attorney, Agent, or Firm* — Ernest G. Cusick; Frank A. Landgraff

(57) ABSTRACT

An arrangement and method adapted for providing a reinforced lower exhaust hood for a steam turbine. Double-wall sidewalls and endwalls for a lower exhaust hood include an outer corrugated wall joined to an inner plate wall. The enhanced strength provided by the corrugation provides reduced deformation of the lower exhaust hood and allows reduction of structural complexity and improved aero-performance within the lower exhaust hood.

21 Claims, 6 Drawing Sheets

CORRUGATED HOOD FOR LOW PRESSURE STEAM TURBINE

BACKGROUND OF THE INVENTION

The invention relates generally to steam turbines and more specifically to lower exhaust hoods for the steam turbines.

The outer shell of a steam turbine is generally called the exhaust hood. The primary function of an exhaust hood is to divert the steam from the last stage bucket of an inner shell to the condenser with minimal pressure loss. Usually the lower half of the exhaust hood supports an inner casing and acts as the supporting structure for the rotor. The upper exhaust hood is usually a cover to guide the steam to the lower half of the hood. The hood for large double flow low-pressure steam turbines are of substantial dimensions and weight and usually are assembled only in the field. In many steam turbines, the inner case of the steam turbine, for example a double flow down exhaust unit has an encompassing exhaust hood split vertically and extending along opposite sides and ends of the turbine. This large, box-like structure houses the entire low-pressure section of the turbine. The exhaust steam outlet from the turbine is generally conically-shaped and the steam exhaust is redirected from a generally axial extending flow direction to a flow direction 90 degrees relative to the axial flow direction. This 90-degree flow direction may be in any plane, downwardly, upwardly or transversely. Thus the prior exhaust hoods for steam turbines constitute a large rectilinear structure at the exit end of the conical section for turning and diffusing the steam flow at right angles.

The lower half of the exhaust hood, split vertically from the upper half directs the exhaust flow of steam to a condenser located generally beneath the exhaust hood. The lower exhaust hood typically supports the inner casing of the turbine and the associated steam path parts such as diaphragms and the like. The lower exhaust hood is further loaded by an external pressure gradient between atmospheric pressure on the outside and near-vacuum conditions internally. The lower exhaust hood shell is generally of fabricated construction with carbon-steel plates. Typical sidewalls for the lower exhaust hood are flat and vertically oriented. To provide resistance to the inward deflection of the sidewalls under vacuum loading, the lower exhaust hood traditionally has included internal transverse and longitudinal plates and struts. These internal transverse and longitudinal plates and struts form a web, generally underneath the turbine casing and extending to the sidewalls. Vertical sidewalls result in a stagnant flow region underneath the inner casing. Flat walled hoods require flow plates. Flow plates are used to prevent the rapid expansion of the exhaust steam after passing through a horizontal joint restriction between the inner casing 25 and the exhaust hood 10.

The use of internal hood stiffeners and flow plates are costly. Further, the thick-walled plate used for the sidewalls is also costly. Prior attempts to stiffen exhaust hoods have focused on different combinations of internal stiffeners (pipe struts, plates) and expanded wall thicknesses.

FIG. 1 illustrates typical arrangements of a low-pressure turbine 100 with an exhaust hood. An exhaust hood 10 includes an upper exhaust hood 15 and a lower exhaust hood 20, mating at a horizontal joint 22. An inner casing 25 is supported at multiple supporting pads 30 on the lower exhaust hood 20. To distribute the load from these pads to a foundation (FIG. 2) for the low-pressure turbine, various supporting structures are present in the form of transverse plates 35, beams 37 and struts 40. These transverse plates 35 avoid the suction effect of the sidewalls 45 and end walls 50 and they distribute the load applied on the hood due to loads on inner casing 25. The lower exhaust hood 20 may further provide a support location 55 for shaft seals (not shown) and end bearings (not shown) for the turbine rotor (not shown). The lower exhaust hood may include a framework 70 including support ledge 75 that may rest on the external foundation (FIG. 2).

The sidewalls 45 and end walls 50 may be constructed of flat metal plates, joined at seams 62 by welding or other known joining methods. Because of the similarity of construction and function, both sidewalls and end walls may hereafter be referred to as "sidewalls". The foundation may be comprised of concrete with an opening, including vertical walls, and sized to accommodate the lower exhaust hood with its vertical sidewalls within.

FIG. 2 illustrates an axial view of a typical exhaust hood for a steam turbine illustrating flat sidewalls and a restricted steam flow path. The exhaust steam flow 65 in the upper exhaust hood 15 must pass by the horizontal joint restriction 80 between the hood 10 and the inner casing 25 before reaching a rectangular chute region 95 that conveys the steam downward to the condenser opening 85 at the bottom of the lower exhaust hood 20. The condenser opening 85 is much larger than the horizontal joint restriction 80, resulting in a stagnant zone 97 underneath the inner casing 25. To avoid uncontrolled expansion downstream of the horizontal joint restriction 80, flow plates 98 are added. To control deflections of the chute region 95 due to the inward-acting pressure gradient, the transverse support plates 35 provide internal stiffening.

The problem previously has been addressed by putting transverse and stiffening plates through out the hood. The methodology heretofore followed has been to make hood stiff enough by adding material so as to avoid excess deflection. The problem is that to control the side and end wall deflections of the hood, transverse stiffeners and struts are required inside of the hood. The existence of these transverse stiffeners and struts increases the complexity of the hood, increases the weight of the hood and creates aero-blockages of the exhaust steam flow path resulting in aero-performance losses.

Accordingly, it may be desirable to provide an alternate hood structure that reduces cost, complexity and improves flow distribution.

BRIEF DESCRIPTION OF THE INVENTION

The present invention relates to an arrangement and method for providing a stiffened lower exhaust hood for a steam turbine. Stiffening may be provided by corrugated reinforcements provided on the outer surface of the lower hood sidewalls.

Briefly in accordance with one aspect of the present invention, a steam turbine exhaust hood is provided. The steam turbine exhaust hood includes a lower exhaust hood joined at a horizontal joint with an upper exhaust hood section. A chute section is provided within the lower exhaust hood. Opposing sidewalls on the chute section include a double-wall.

According to a further aspect of the present invention, a method is provided for reinforcing sidewalls of a lower exhaust hood of a steam turbine exhaust hood. The method includes reinforcing the opposing sidewalls with a double sidewall on a chute section below a horizontal joint of the lower hood.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
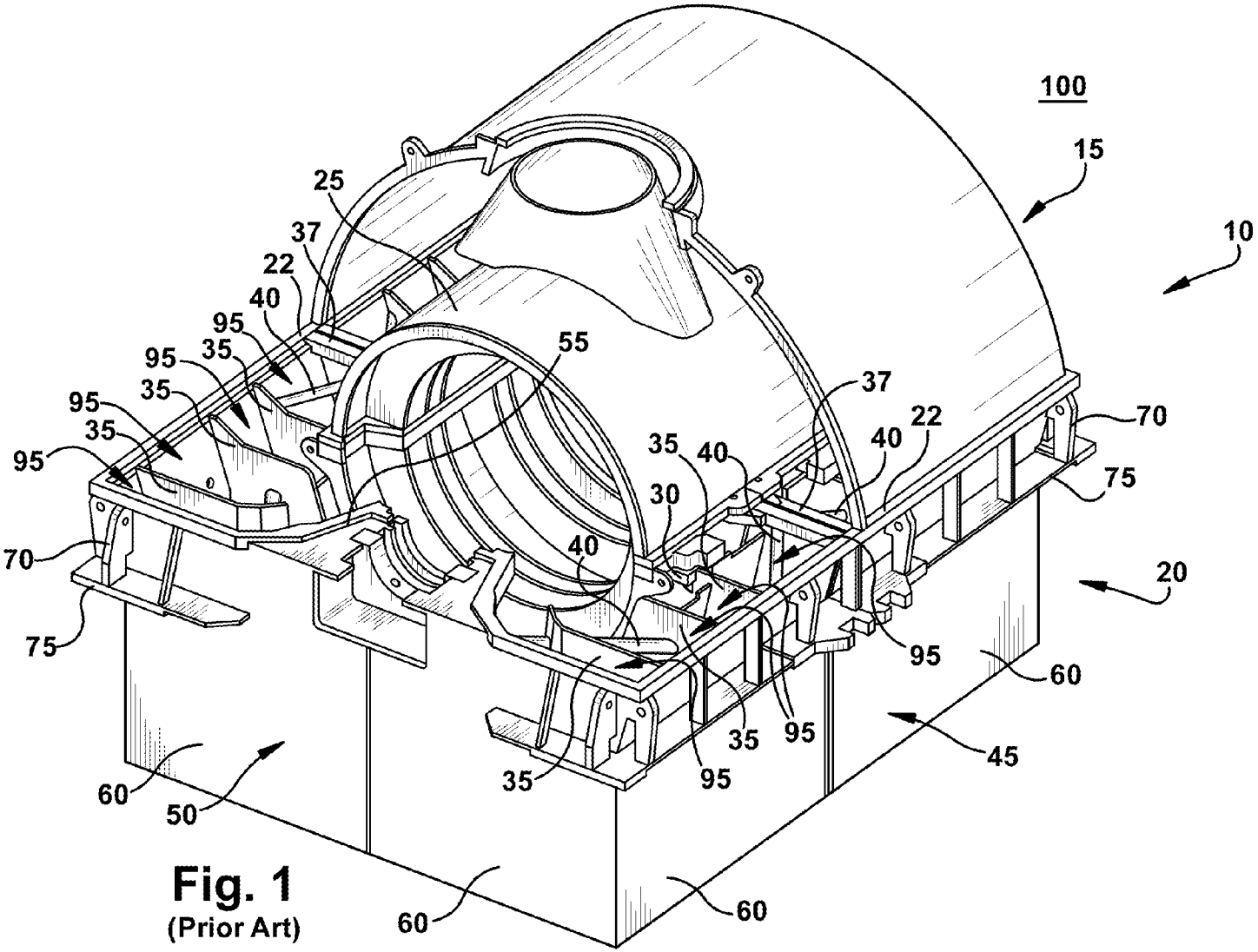
Fig. 1 (Prior Art)
FIG. 1 illustrates typical arrangements of a low-pressure turbine with an exhaust hood.
Figure 2:
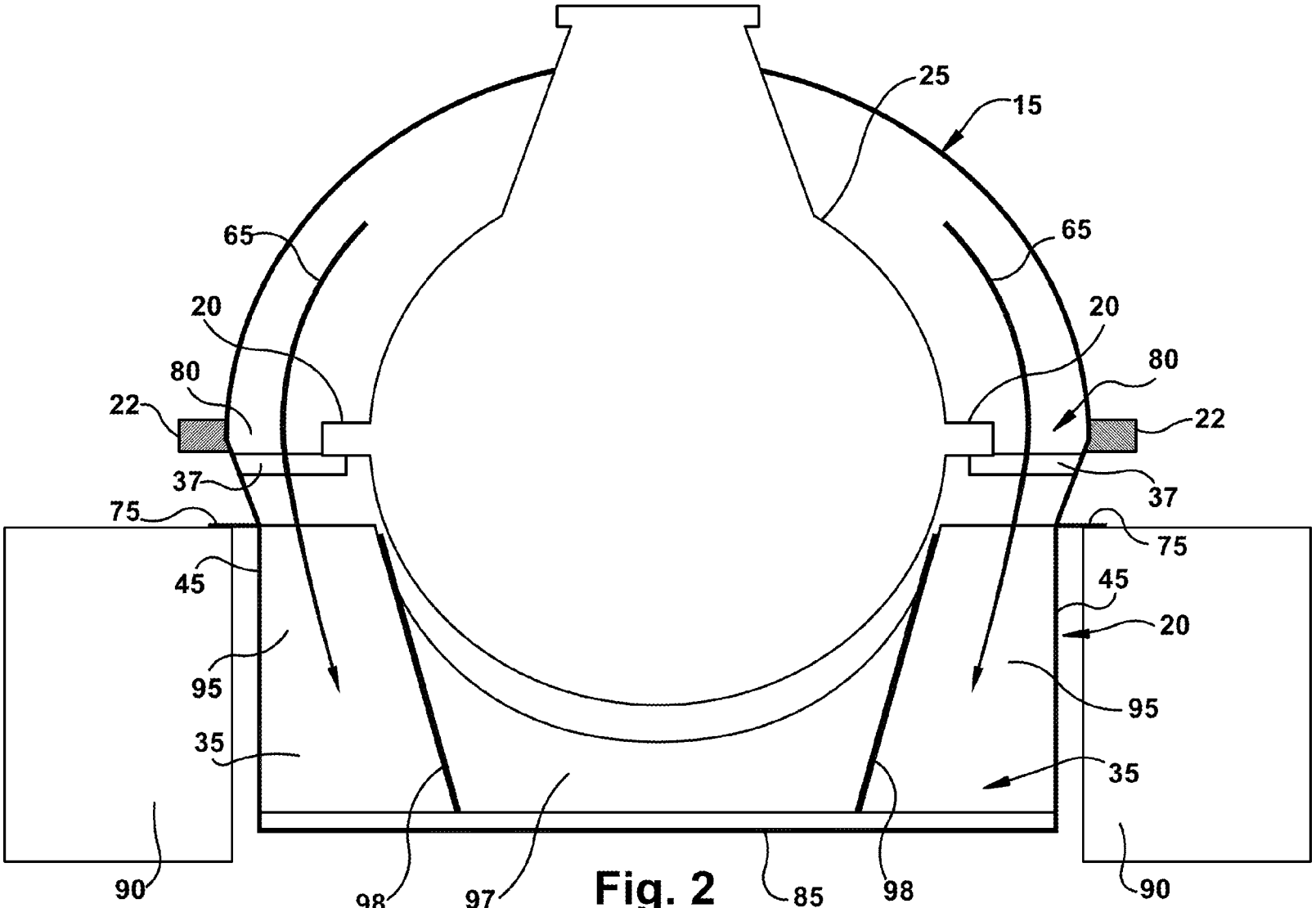
Fig. 2 (Prior Art)
FIG. 2 illustrates an axial view of a typical exhaust hood for steam turbine illustrating flat sidewalls and a limited steam flow path.

The following embodiments of the present invention have many advantages, including improving both the stiffening of the sidewalls of the lower exhaust hood and the flow distribution in the chute region of the lower exhaust hood. The opposing sidewalls are reinforced by the use of double-walls, including a corrugated backing to add strength and save weight. The corrugated backing wall adds strength to resist deformation of the sidewalls and endwalls due to the pressure gradient between the outside atmosphere and the vacuum condition within the exhaust hood. The stiffness improvement will have a positive impact on clearance between the stator and rotor components of the turbine, due to reduced end wall deflection. The added strength of the opposing sidewalls further allows reduction of transverse stiffeners and struts within the lower hood, thereby providing enhanced flow distribution and improved aero-performance and thermodynamic performance of the exhaust hood. The use of double-wall structures may further allow the plate thickness of the sidewalls to be reduced by about half compared to typical prior art designs. The reduction of the support structures internal to the exhaust hood and reduced plate size will further provide material and assembly cost savings.

In the present invention, large-expanse, flat sidewall(s) of a chute section of a lower exhaust hood below the horizontal joint are reinforced as double-walls. The double walls include an outer corrugated wall joined to a first plate wall. The inner plate wall includes essentially flat plates. The outer corrugated wall may include a plurality of discrete corrugated elements. The discrete corrugated elements may be aligned parallel to each other and generally axially along a back face of the inner plate wall. Alternatively, the discrete corrugated elements may be aligned parallel to each other and generally vertically along a back face of the inner plate wall.

The discrete corrugated elements may be comprised of a plurality of flat plate elements joined together along a length of the corrugation. The plurality of flat plate elements may be joined by any of various known joining methods, such as welding. The flat plate elements joined along the length of the corrugation may form any of a number shapes relative to the inner plate wall, including a trapezoid and a box. The discrete corrugation elements may be shaped from single plates formed into flute shapes such as a semi-circle or semi-ellipse. The corrugation may further include beam shapes, including but not limited to an I beam, an H beam and a T beam. The corrugation using the beam-shape may be disposed horizontally or vertically on the outside surface of the inner wall plate.

The corrugated backing may occupy a gap between the inner plate wall of the lower exhaust hood and the surrounding foundation when the steam turbine is installed.

According to another embodiment of the present invention, a method is provided for strengthening sidewalls of a lower exhaust hood of a steam turbine by providing double-walls for the sidewalls of a chute section of the lower exhaust hood. The method includes joining an outer corrugated wall to an inner plate wall, where the inner plate wall may include an essentially flat plate wall. The method further comprises arranging multiple discrete corrugation elements of the outer corrugated wall, parallel to each other and generally axially along an outside face of the inner plate wall. Alternatively, the method for strengthening opposing sidewalls may include arranging a plurality of discrete corrugation elements of the outer corrugated wall, parallel to each other and generally vertically along an outside face of the inner plate wall.

The method for strengthening opposing sidewalls may also include joining flat plate elements along a length of the corrugation to form the discrete corrugation elements. The flat plate elements may be joined at a seam along a length of the element by welding or other known joining methods. The method may include joining the flat plate elements in different configurations to provide reinforcement for the inner plate wall. The joining of the flat plate elements may include forming a trapezoid-like or box-like element relative to the inner plate wall.

Alternatively, the method may include forming the discrete corrugated elements by bending or shaping plate in various shapes, including a fluted arrangement relative to the inner plate wall. The method may also include joining the fluted corrugation elements to the inner plate wall. The method for strengthening opposing sidewalls may also include joining stiffening beam elements to the inner plate wall.

Any combination of the discrete corrugated elements joined to the inner plate wall of the opposing sidewalls of the lower exhaust hood may reduce or eliminate the need for internal stiffeners and thick sidewalls, reducing hood cost. Removal of internal stiffeners also reduces flow blockage, improving aerodynamic performance. The sidewalls are oriented to manage steam expansion within the chute, also improving aerodynamic performance. Better flow management within the chute, to make better use of the stagnant region underneath the inner casing, reduces the need for costly flow plates. In addition, it allows a smaller condenser opening, reducing overall plant cost.

Figure 3:
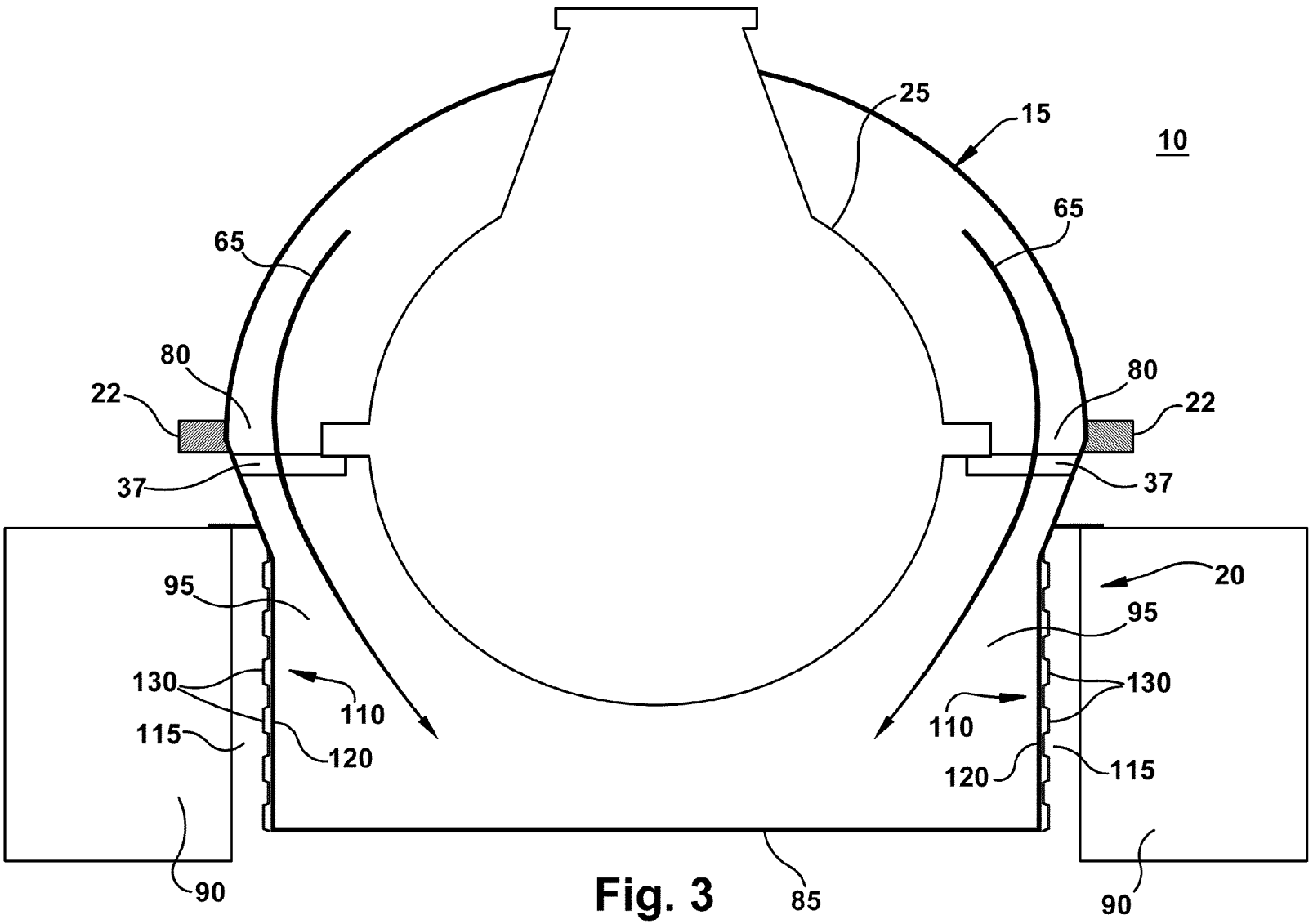
FIG. 3 illustrates an axial view of an embodiment of an inventive exhaust hood for a steam turbine incorporating corrugated double sidewalls for the lower exhaust hood.

FIG. 3 illustrates an axial view of an embodiment of an inventive exhaust hood for a steam turbine incorporating corrugated double sidewalls for the lower exhaust hood of a steam turbine. In the inventive arrangement, the sidewalls 110 in the chute region 95 of the lower exhaust hood 20 include double-walls. The double-walled sidewalls 110 extend generally vertically from support ledge 75. A space 115 is provided between the sidewalls and the foundation 90. The double-walled sidewalls 110 include inner plate 120 and a corrugated outer wall 130. The inner plate 120 may be unitary or may include seamed arrangement of smaller plates joined by welding or other known joining methods. The corrugations may be provided in various orientations, but usually may be arranged axially or vertically with respect to the exhaust hood. The corrugated outer wall may be joined to the inner wall by welding or other known joining methods. The corrugations illustrated in FIG. 3 are of a trapezoidal arrangement, however, other corrugation arrangements may alternatively be employed in the double-wall.

Figure 4A:
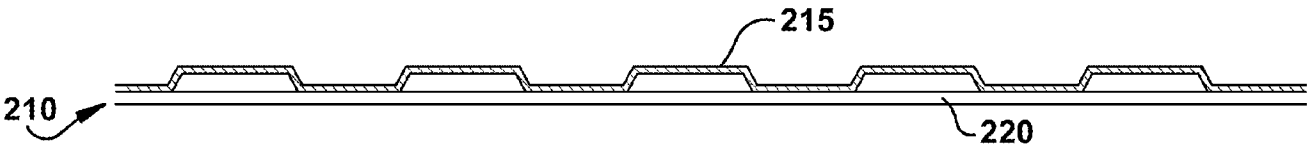
FIGS. 4A-4D illustrate exemplary corrugated wall elements that may be employed in the double-wall sidewalls of the lower exhaust hood.
Figure 4B:
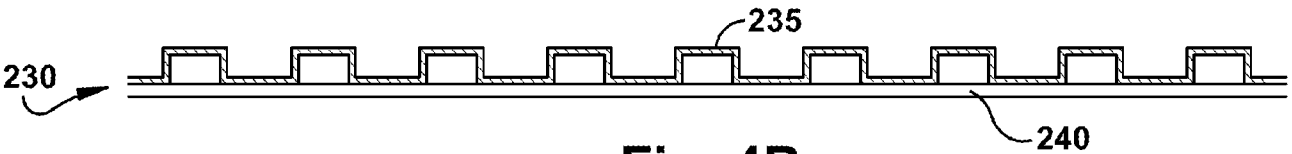
Figure 4C:
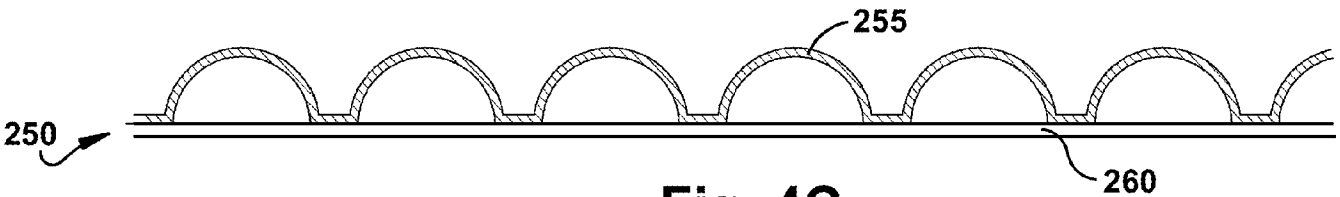
Figure 4D:
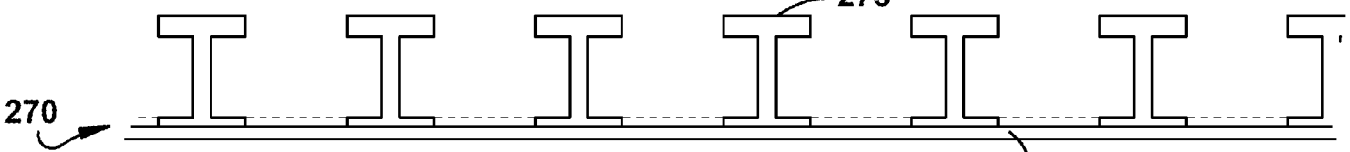

FIGS. 4A-4D illustrate exemplary corrugated wall elements that may be employed in the double-wall sidewalls of the lower exhaust hood. FIG. 4A illustrates a double sidewall 210 including a trapezoidal corrugation 215 on a flat plate inner wall 220. FIG. 4B illustrates a double sidewall 230 including a box corrugation 235 on a flat plate inner wall 240. FIG. 4C illustrates a double sidewall 250 including a fluted corrugation 255 on a flat plate inner wall 260. FIG. 4D illustrates a double sidewall 270 including I beam corrugation 275 on a flat plate inner wall 280.

Figure 5:
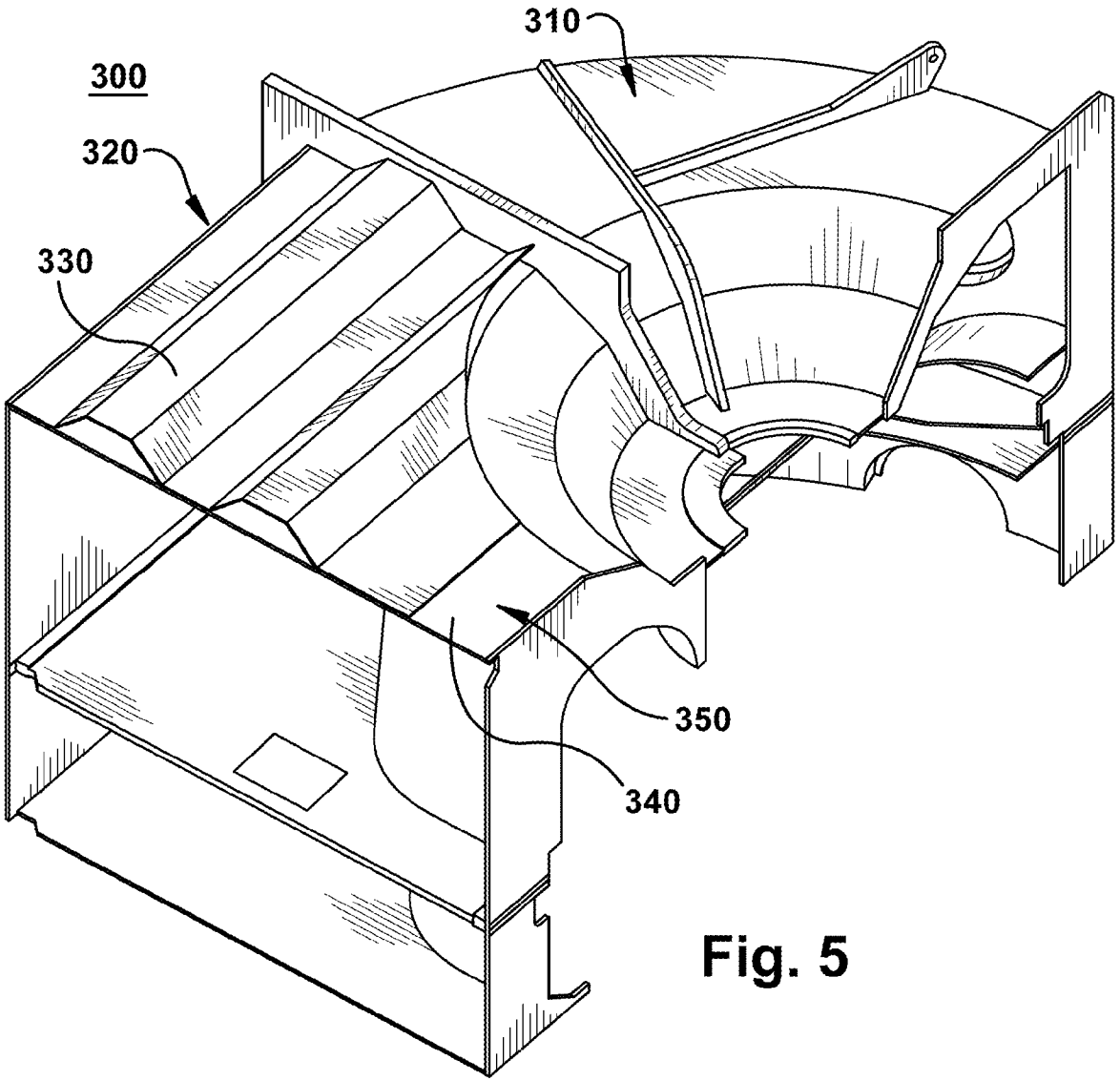
FIG. 5 illustrates a partial cutaway isometric view of an exhaust hood for a steam turbine incorporating trapezoidal corrugation on a lower exhaust hood.

FIG. 5 illustrates a partial cutaway isometric view of an exhaust hood for a steam turbine incorporating trapezoidal corrugation on a lower exhaust hood. The exhaust hood section 300 includes an upper exhaust section 310 and a lower exhaust hood section 320. Trapezoidal corrugated wall 330 is joined to an outer surface 340 of inner plate wall 350 to form a double-wall, providing added strength and deformation resistance to the sidewalls.

Figure 6:
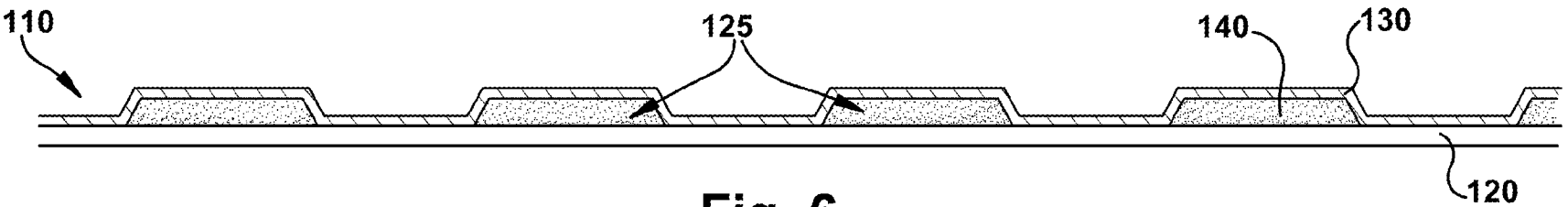
FIG. 6 illustrates thermal insulation between an inner plate wall and a corrugated backing wall of the sidewalls for the lower exhaust hood.

FIG. 6 illustrates thermal insulation between an inner plate wall and a corrugated backing wall of the sidewalls for the lower exhaust hood. According to another aspect of the present invention, thermal insulation 140 may be provided in space 125 between the inner plate wall 120 and the corrugated backing wall 130. The thermal insulation reduces heat loss from the exhaust hood to the ambient outside the sidewall 110. A thermal insulating material, such as but not limited to glass wool may be utilized.

While various embodiments are described herein, it will be appreciated from the specification that various combinations of elements, variations or improvements therein may be made, and are within the scope of the invention.

The invention claimed is:

1. A steam turbine exhaust hood comprising:

a lower hood section joined at a horizontal joint with an upper exhaust hood section;

a chute section of the lower exhaust hood; and opposing sidewalls on the chute section below the horizontal joint, including a double-wall for the opposing sidewalls.

2. The steam turbine exhaust hood according to claim 1, wherein the double wall for the opposing sidewalls comprise an outer corrugated wall joined to an inner plate wall.

3. The steam turbine exhaust hood according to claim 2, wherein the inner plate wall for the opposing sidewalls comprise an essentially flat plate.

4. The steam turbine exhaust hood according to claim 3, wherein an insulation material fills a space between the inner plate wall and the outer corrugated wall.

5. The steam turbine exhaust hood according to claim 3, wherein the outer corrugated wall comprises plurality of discrete corrugation elements joined together parallel to each other and generally axially along an outer face of the inner plate wall.

6. The steam turbine exhaust hood according to claim 5, wherein the discrete corrugation elements comprise a plurality of flat plate elements joined together along a length of the corrugation.

7. The steam turbine exhaust hood according to claim 5, wherein the plurality of discrete corrugation elements aligned generally vertically along the back face of the inner plate wall comprise flute elements.

8. The steam turbine exhaust hood according to claim 5, wherein the plurality of discrete corrugation elements aligned generally vertically and parallel along the back face of the inner plate wall comprise beam elements.

9. The steam turbine exhaust hood according to claim 3, wherein the outer corrugated wall comprises plurality of discrete corrugation elements joined together parallel to each other and generally vertically along an outer face of the inner plate wall.

10. The steam turbine exhaust hood according to claim 9, wherein the flat plate elements joined together along a length of the corrugation form a trapezoid relative to the inner plate wall.

11. The steam turbine exhaust hood according to claim 9, wherein the flat plate elements joined together along a length of the corrugation form a box profile relative to the inner plate wall.

12. A method for strengthening sidewalls of a lower exhaust hood of a steam turbine exhaust hood comprising:

providing opposing sidewalls for a chute section of the lower exhaust hood, wherein the opposing sidewalls include a double-wall.

13. The method for strengthening sidewalls according to claim 12, further comprising:

joining an outer corrugated wall to an inner plate wall.

14. The method for strengthening opposing sidewalls according to claim 13, further comprising: arranging a plurality of discrete corrugation elements of the outer corrugated wall, joined parallel to each other and generally axially along an outside face of the inner plate wall.

15. The method for strengthening opposing sidewalls according to claim 13, further comprising: arranging a plurality of discrete corrugation elements of the outer corrugated wall, joined parallel to each other and generally vertically along an outside face of the inner plate wall.

16. The method for strengthening opposing sidewalls according to claim 12, comprising:

providing an essentially flat plate wall as the inner plate wall.

17. The method for strengthening opposing sidewalls according to claim 16, comprising: joining flat plate elements along a length of the corrugation to form the discrete corrugation elements.

18. The method for strengthening opposing sidewalls according to claim 16, the step of joining flat plate elements comprising: joining the flate plate elements as a trapezoid relative to the inner plate wall.

19. The method for strengthening opposing sidewalls according to claim 16, the step of joining flat plate elements comprising: joining the flate plate elements as a box relative to the inner plate wall.

20. The method for strengthening opposing sidewalls according to claim 16, the arranging a plurality of discrete corrugation elements comprising: joining fluted corrugation elements to the inner plate wall.

21. The method for strengthening opposing sidewalls according to claim 16, the arranging a plurality of discrete corrugation elements comprising: joining stiffening beam corrugation elements to the inner plate wall.

* * * * *

UNITED STATES PATENT AND TRADEMARK OFFICE

CERTIFICATE OF CORRECTION

PATENT NO. : 8,221,054 B2
APPLICATION NO. : 12/473798
DATED : July 17, 2012
INVENTOR(S) : Rao et al.

It is certified that error appears in the above-identified patent and that said Letters Patent is hereby corrected as shown below:

In Column 1, Line 32, delete “half” and insert -- half, --, therefor.

In Column 6, Line 48, in Claim 18, delete “flate” and insert -- flat --, therefor.

In Column 6, Line 52, in Claim 19, delete “flate” and insert -- flat --, therefor.

Signed and Sealed this
Twenty-seventh Day of November, 2012

David J. Kappos

David J. Kappos
*Director of the United States Patent and Trademark Office*